United States Patent [19]

Gross

[11] 4,195,577

[45] Apr. 1, 1980

[54] PORTABLE HANGING SHELF

[76] Inventor: Leo H. Gross, 546 NE. 73rd St., Miami, Fla. 33138

[21] Appl. No.: 949,901

[22] Filed: Oct. 10, 1978

[51] Int. Cl.[2] ..... A47B 41/04

[52] U.S. Cl. ..... 108/31; 108/42; 211/90

[58] Field of Search ..... 108/31, 42, 149, 92; 211/90, 153

[56] References Cited

U.S. PATENT DOCUMENTS

| | | | |
|---|---|---|---|
| 523,679 | 7/1894 | McLenathan | 108/42 |
| 883,001 | 3/1908 | Curtis | 108/42 X |
| 1,069,411 | 8/1913 | Greene | 211/90 |
| 2,266,274 | 12/1941 | Schroeder | 108/42 X |
| 2,818,317 | 12/1957 | Little, Jr. | 108/149 X |
| 4,118,087 | 10/1978 | Dorf | 211/153 |

FOREIGN PATENT DOCUMENTS

| | | | |
|---|---|---|---|
| 645291 | 7/1962 | Canada | 211/90 |
| 392789 | 10/1908 | France | 108/42 |

*Primary Examiner*—Ramon S. Britts
*Assistant Examiner*—Peter A. Aschenbrenner

[57] ABSTRACT

A portable hanging shelf designed to fit within various sizes of window frames, including an adjustable shelf with a first portion slidably overlaying and interconnecting with a second portion, each portion having a base with front and rear downwardly extending sides and ends also downwardly extending. The first portion overlays and slidably interconnects with the second portion and the sliding motion is limited by the ends. Each base side includes two holes spaced from the ends. The portable hanging shelf includes an adjustable support rod which is forced between the side walls of a window frame, perpendicular to the side walls and parallel to the frame bottom. The tension created by forcing the adjustable rod within the window frame is sufficient to support the weight of the rod plus a predetermined additional weight attached to the rod. The portable shelf includes a plurality of wire hangers. Each hanger includes a pair of legs with upwardly turned ends and a curved middle portion. The curved middle portion fits compatably over the support rod and the ends matingly engage the base holes, thereby supporting the shelf and suspending it within the window frame.

7 Claims, 5 Drawing Figures

PORTABLE HANGING SHELF

FIELD OF INVENTION

This invention generally relates to shelves and more particularly to portable hanging shelves. Specifically, the invention relates to portable hanging shelves which are designed to fit within a window frame.

BACKGROUND OF THE INVENTION

In the past there have been many shelves designed to fit within a window frame. Typically, these shelves are fixed within a window frame. Typically, a 90° brace or T-brace is used to support a shelf. One end of the brace is screwed to the window frame while the other end of the brace is screwed to the frame side walls. This type of shelf is quite well adapted to support plant, pots, and the like. However, it is extremely difficult for a user to move the shelf from one window frame to another. For instance, when the user desires to move his hanging shelf from one window frame to another, it becomes necessary for him to unscrew the 90° or T-brace from the shelf and the window frame with tools and then to rescrew it back into the window frame where it is desired to be moved. In addition, if the user is an apartment dweller, he must putty over the holes made in the window frame when he leaves. This is destructive and time consuming as well as somewhat costly. There has not previously been a hanging shelf which is easily portable and can be moved from one location to another without the use of tools for such an operation.

Applicant's structure solves problem of portability with great convenience to the user. Applicant's structure requires no tools or mechanical ability in order to move the shelf from one location to another. In addition, applicant's structure provides an ideal setting for plants, pots, or the like within a window frame. The user of applicant's structure merely adjusts the rod and shelf to the desired length and height and forces the rod between the frame side walls and then hangs the shelf in place, adjusting the shelf to its desired length.

Applicant's structure includes offset hanging means which enables a user to effectively use applicant's structure even in a narrow window frame.

OBJECT OF THE INVENTION

Generally, the object of this invention is to provide the user with an inexpensive portable means for hanging plants, pots, or the like upon the shelf at great convenience and low cost to the user. In accordance with these and other objects which will become apparent hereinafter, the invention will now be described with reference to the accompanying drawings in which:

DESCRIPTION OF THE PREFERRED EMBODIMENT

Figure 1:
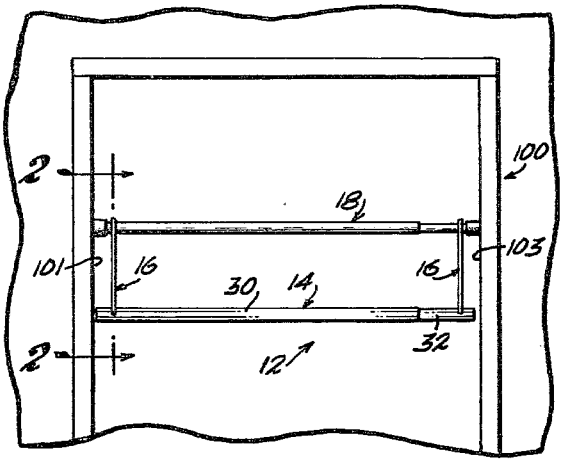
FIG. 1 is a front elevational view of applicant's invention mounted in a window frame.
Figure 2:
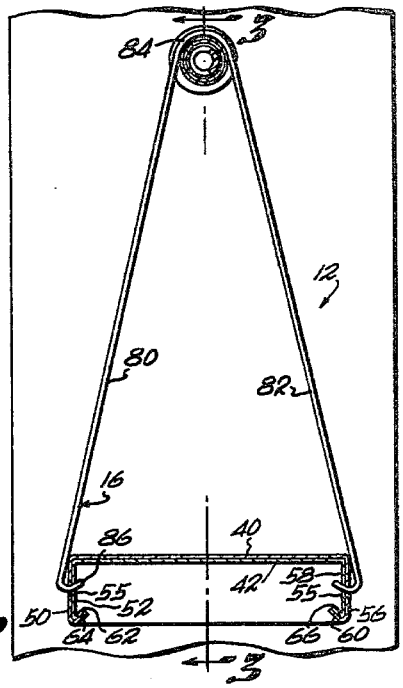
FIG. 2 is a side elevational view of applicant's invention.
Figure 3:
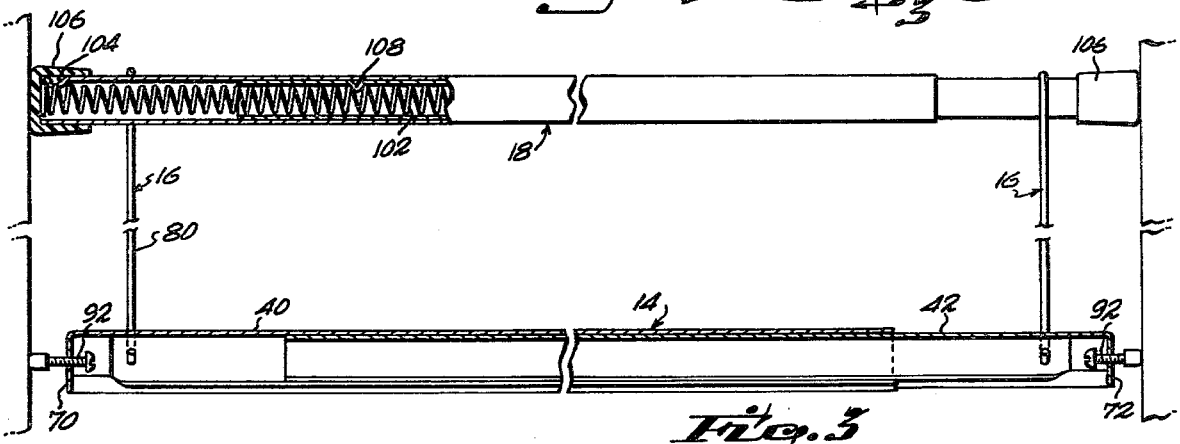
FIG. 3 is a front sectional elevational view exposing the spring in the tubular support rod and showing the first portion of the shelf slidably interconnecting with the second portion.

Referring to the drawings wherein like reference characters designate like or corresponding parts throughout the several views and referring particularly to FIG. 2, there is shown the invention, a portable hanging shelf, generally designated by the numeral 12. It will be noted that the invention comprises three basic elements; an adjustable shelf 14, hangers 16, and an adjustable rod 18. The adjustable shelf as seen in FIG. 1 includes a first portion 30 and second portion 32. The first portion 30 overlays and slidably interconnects with the second portion 32. As seen in FIG. 3, the shelf is composed of a first portion base 40 and a second portion base 42. Together these bases form the shelf generally designated by the numeral 14.

Figure 4:
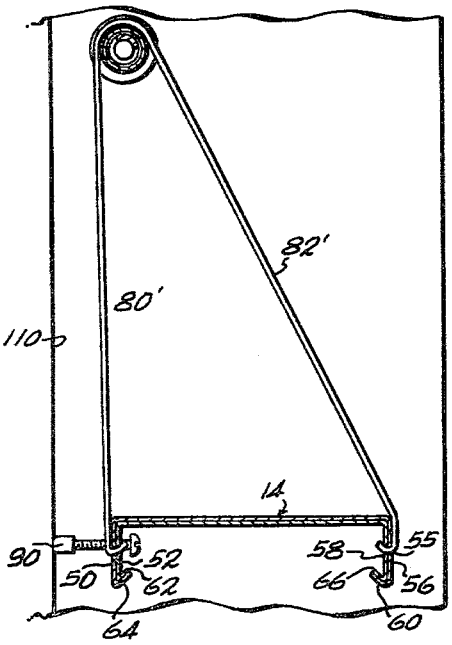
FIG. 4 is a side elevational view showing an offset hanger with screw extenders for stopping rearward movement.

With particular reference to FIG. 4, there is shown the shelf 14 having downwardly extending sides. The first portion of the shelf includes front and rear sides designated 56 and 50 respectively. The second portion includes downwardly extending front and rear sides 58 and 52. The front and rear sides of the first portion have upward turned edges 64 and 60 respectively which serve as guides for the second portion as it slidably interconnects with the first portion. It will be noticed that the second portion sides 58 and 52 could also have upturned ends as seen in FIG. 4 at 66 and 62. Although the edges are not necessary to applicant's basic invention, they do further facilitate the adjustability of the portions. It will be noted that other means for guiding the first portion over the second portion can be used within applicant's embodiment as stated herein.

The shelf 14 also includes ends 70 and 72 as seen in FIG. 3. These ends are downwardly extending approximately the same distance as the sides. The ends act as stop means when the first portion overlays and slidably interconnects with the second portion.

The shelf includes holes 55 in the first and second portions at the front and rear sides of each spaced from each other and the shelf ends 70 & 72 to allow hangers 16 to be inserted therein.

The shelf can be made of metal or plastic or any suitable material provided that the material is rigid enough to support plants, pots, or the like while the shelf is in the hanging position as seen in FIG. 1. Sheet metal or other similar inexpensive material has been used and provides an excellent support plants, pots, or the like.

With particular reference to FIG. 1 there is shown the adjustable rod within the window frame 100. More particularly, the rod is forced between side walls 101 and 103 of the window frame 100 with sufficient tension to suspend the rod even when the rod has additional weight attached to it. As can be seen in FIG. 3, the rod is adjustable having a tubular frame 18. The rod is spring loaded because spring 102 is inserted in the tubular frame 18 and fixably attached to the rod as at 104. The tubular frame of the rod 18 includes a notch 108 which allows the rod to turn in either direction and still create tension on the ends as 104. As the rod turns, the tubular frame get small or larger depending the direction the rod is turned. This rod is particularly well suited to applicant's invention because the rod can be made to fit within most window frames without the necessity of tools. As seen in FIG. 3, the rod ends 104 are provided with a rubber stopper such as 106 which fits over the rod end 104. The rod can thus be fitted to most any window frame.

With particular reference to FIG. 1 there is shown hanger 16. The hangers include legs 80 and 82 and a curved middle portion such as 84. The curved middle portion 84 compatably fits over the adjustable rod 18. The legs hang downward from the rod and connect the base holes 55 with the leg upturned ends 86. In this manner, the shelf hangs suspended. In the embodiments such as in FIG. 2, there is shown the hangers having legs equidistant from center line 3—3 of the middle shelf and the rod. The legs are bent in such a manner that the center line 3—3 of the shelf hangs on the same axis as the rod. In this embodiment, the center of gravity is directly below the rod.

With particular reference to FIG. 4, it will be seen that the shelf can be made to fit within a window frame having even relatively narrow side walls. In this embodiment the hangers are bent at an offset. The leg 82' has approximately the same angle with the shelf center line as it did in embodiment in FIG. 2. However, leg 80' has been bent at an offset to be parallel with window pane 110. Under these conditions, the normal gravitational force causes the shelf to swing backwards in order to seek its center of gravity. The applicant has provided the shelf base side 50 and 52 of the first and second portions respectively with a pair of adjustable screw extensions 90 (one shown) to stop this rearward motion as seen in FIG. 4. In this manner the shelf is parallel with the sill because the screw extensions 90, prevent the rearward movement. In addition, screw extensions 92 could be provided at ends 70 and 72 to prevent rearward movement. In addition, adhesive means could be provided to screw extension 92 at the point where the screw extensions meet the side walls.

Figure 5:
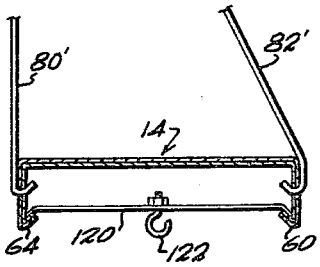
FIG. 5 is a sectional view of the applicant's invention with a hanging plate for supporting a hook upon which various hanging items may be placed.

With particular reference to FIG. 5, there is shown a hanging plate 120 which is fitted over the base edges 60 and 64. The hanging plate 120 hangs under the shelf 14 and includes a hook 122 for suspending hanging plants.

The shelf can also be equipped with structure for locking the slidable portions 30 and 32 in place (not shown).

In addition, the base ends 70 and 72 could be fitted with screw extensions 92 such that additional tension and rigidity can be provided to the applicant's shelf to prevent the shelf from buckling or moving.

While the description and disclosure accompanying the same have been described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed is:

1. For hanging within a window frame having a first and second side wall and a bottom sill and including a window pane between the first and second side walls, a portable shelf comprising:

an adjustable shelf comprising a first and a second mating longitudinally extendible portions and mutually interconnecting guide means on the portions including stop means to limit longitudinal movement of the portions toward one another, the shelf being adjustable to fit between the window frame side walls, adjacent the window pane, adjustable support rod means for the shelf having a first and second end, the rod comprising a first and a second telescoping tubular member and spring means captivated between the ends of the rod and normally urging the rod portions away from each other to thrust the first and second rod ends into engagement with the first and second window frame side walls to create a normal force on the side walls and consequent frictional force able to withstand a gravitational load in excess of the weight of the portable shelf, and shelf hanging means to suspend the shelf in hanging relation to the rod comprising hangers bent at an offset such that one leg is parallel to the window pane while the other leg is at an angle to the parallel leg and diverging from it thereby the center of gravity of the shelf is moved forward such that the shelf remains parallel with the bottom sill.

2. A portable hanging shelf as recited in claim 1 wherein the shelf includes ends having friction means to increase the frictional force on the side wall thereby allowing an additional weight to be placed on the shelf when the shelf is in hanging relation to the rod.

3. A portable hanging shelf as recited in claim 1 wherein the shelf includes stop means, the stop means prevents the shelf from rearward movement.

4. A portable hanging shelf as recited in claim 2 wherein the shelf has a rear zone which includes stop means thereby allowing the stop means to rest upon the window frame and prevent rearward movement.

5. A portable hanging shelf as recited in claim 2 wherein the shelf includes ends and stop means are attached to the ends, the stop means rest upon the first and second side walls of the window frame preventing rearward movement.

6. A portable hanging shelf as recited in claim 1 wherein the shelf includes front and rear downwardly extending sides, the sides include upturned edges such that a hanging plate with downward turned edges can be forced over the upturned edges of the shelf and the hanger plate remains in place, the hanger plate includes hanger means.

7. A portable hanging shelf as recited in claim 1 wherein means are provided for locking the first and second portions after the first portion overlays and slidably interconnects with the second portion.

* * * * *